US005245838A

United States Patent [19]

Cavalea, III

[11] Patent Number: 5,245,838

[45] Date of Patent: Sep. 21, 1993

[54] PORTABLE REFRIGERATION UNIT

[75] Inventor: Anthony C. Cavalea, III, Homer Township, Champaign County, Ill.

[73] Assignee: Cavalea Continental Freight Inc., Chicago, Ill.

[21] Appl. No.: 854,207

[22] Filed: Mar. 20, 1992

[51] Int. Cl.[5] ..... F25D 23/00

[52] U.S. Cl. ..... 62/259.1; 62/297; 62/298; 62/457.1

[58] Field of Search ..... 62/297, 457.9, 457.1, 62/237, 259.1, 298; 52/127.9

[56] References Cited

U.S. PATENT DOCUMENTS

| | | | |
|---|---|---|---|
| 2,647,287 | 8/1953 | Jones | 52/127.9 X |
| 2,984,084 | 5/1961 | Talmey et al. | 62/297 X |
| 3,205,674 | 9/1965 | Arnold et al. | 62/259.1 X |
| 3,296,756 | 1/1967 | Wade | 52/127.9 X |
| 3,855,814 | 12/1974 | Eubank | 62/237 X |
| 3,961,925 | 6/1976 | Rhoad | 62/457.9 X |
| 4,233,500 | 9/1980 | Clark et al. | 52/127.9 X |
| 4,644,832 | 11/1986 | Hagen | 62/344 |
| 4,662,189 | 5/1987 | Puppel | 62/259.1 X |
| 4,773,230 | 9/1988 | Garrett | 62/237 |
| 4,898,004 | 2/1990 | Richardson | 62/298 X |
| 4,991,402 | 2/1991 | Saia, III | 62/457.9 X |

FOREIGN PATENT DOCUMENTS

| | | | |
|---|---|---|---|
| 2169997 | 7/1986 | United Kingdom | 62/237 |

*Primary Examiner*—William E. Tapolcai

*Attorney, Agent, or Firm*—Wallenstein, Wagner & Hattis, Ltd.

[57] ABSTRACT

A portable, modular refrigeration unit is disclosed. The portable, modular refrigeration unit comprises an insulated structure including a floor, a roof, and a plurality of wall panels. Latches contained in the wall panels interconnect the wall panels to form a continuous wall disposed between the floor and the roof. A U-shaped channel is adapted for supporting a refrigeration evaporator unit within the structure. A frame horizontally supports the floor of the structure above the ground. The frame extends beyond the floor and is adapted to support a refrigeration compressor unit coupled to the evaporator unit.

5 Claims, 2 Drawing Sheets

PORTABLE REFRIGERATION UNIT

DESCRIPTION

1. Technical Field

The present invention relates to a refrigeration unit, such as a cooler and heater or a freezer, and more particularly, to a portable, modular refrigeration unit which can easily be transported to, and set up at, outdoor events, such as golf tournaments.

2. Background Prior Art

Many outdoor events at which food is sold, such as golf tournaments, require temporary food coolers and freezers In the past, large, one-piece refrigerated containers, such as ones sitting on a flatbed trailer, were hauled to the event and unloaded from the trailer. However, because of their large size, the refrigerated containers were difficult unload and setup, often requiring equipment which would damage the golf course.

Alternatively, refrigerated trailers, such as pulled by semi-tractors, were used. However, the semi-tractors could also damage the golf course. Further, they were difficult to setup on uneven ground.

Additionally, these prior refrigeration units were relatively unsightly.

The present invention is provided to solve these and other problems.

SUMMARY OF THE INVENTION

It is an object of the invention to provide a portable, modular refrigeration unit. In accordance with the invention, the portable, modular refrigeration unit comprises an insulated structure including a floor, a roof, and a plurality of wall panels. Latches contained in the wall panels interconnect the wall panels to form a continuous wall disposed between the floor and the roof. A U-shaped channel is adapted for supporting a refrigeration evaporator unit from the ceiling of the structure. A frame horizontally supports the floor of the structure above the ground. The frame extends beyond the floor and is adapted to support a refrigeration compressor unit coupled to the evaporator unit.

The portable, modular refrigeration unit can easily be transported and assembled at remote locations without the need for heavy equipment. By placing the compressor remote from the evaporator, supported by the frame, the compressor and evaporator can be sized for proper cooling, even under heavy heat load conditions.

Other features and advantages of the invention will be apparent from the following specification taken in conjunction with the following drawing.

DETAILED DESCRIPTION

Figure 1:
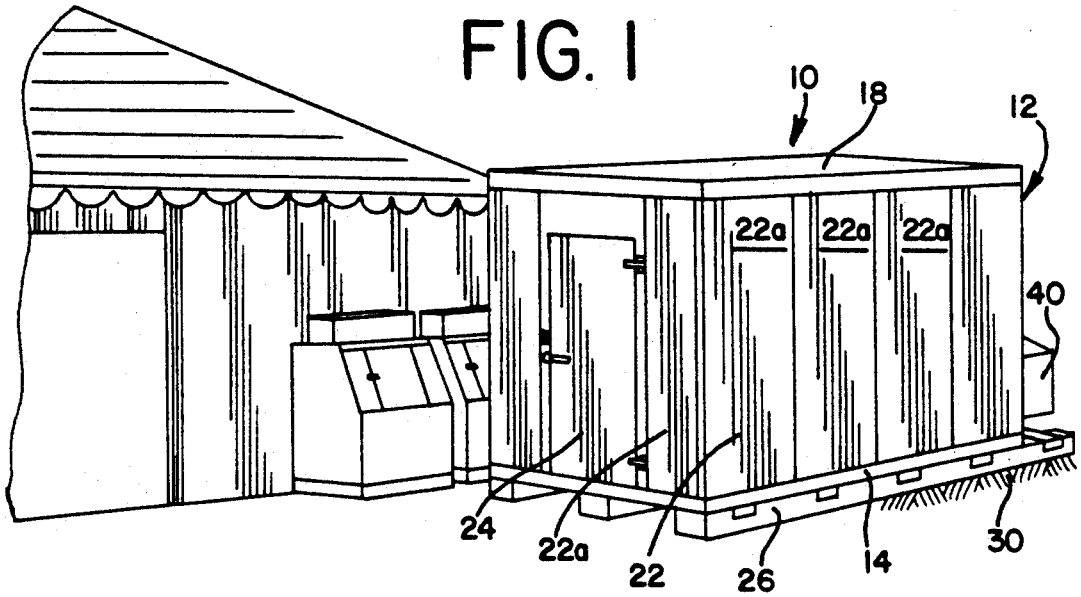
FIG. 1 is a perspective view of a portable, modular refrigeration unit made in accordance with the invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A portable, modular refrigeration unit, generally designated 10, is illustrated in FIG. 1. The refrigeration unit 10 is typically utilized to keep food chilled, and/or frozen, at outdoor events, especially those where the need for refrigeration is only temporary.

The refrigeration unit 10 comprises an insulated structure 12, including a floor 14, a roof 8, and four walls 22. The roof 18 comprises a plurality of roof panels **18*a*, and the walls 22 each comprise a plurality of wall panels 22*a*. The floor 14, roof panels 18*a* and wall panels 22*a*** are sold by Bangor Cooler Co., Hartford, Mich. 49057.

Figure 7:
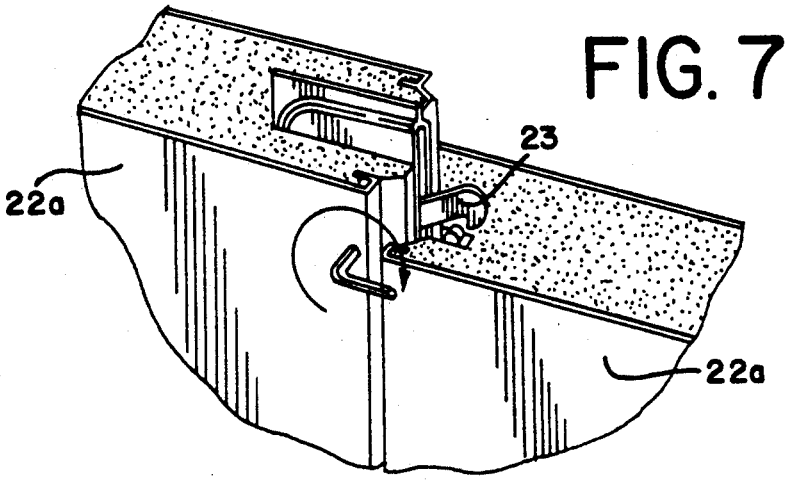
FIG. 7 is a perspective view of a latch used to interconnect adjacent wall panels.

The wall panels **22*a* are interconnected to form a continuous wall disposed between the floor 14 and the roof 18. As illustrated in FIG. 7, the wall panels 22*a* are interconnected by a conventional cam-lock 23, which is also supplied by Bangor. Similarly, the cam-lock 23 is used to connect the wall panels 22*a* to the floor 14 and to the roof 18. One of the wall panels 22*a* contains a door 24**.

Figure 2:
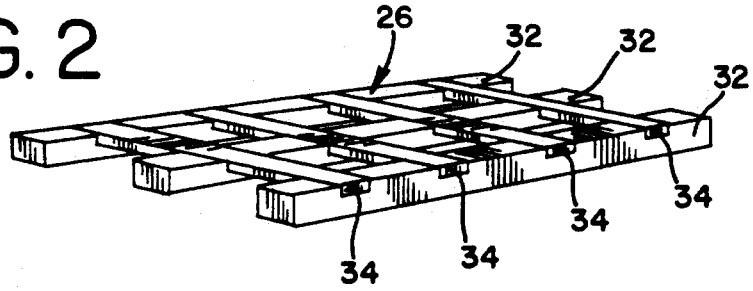
FIG. 2 is a perspective view of a frame as used with the invention.
Figure 3:
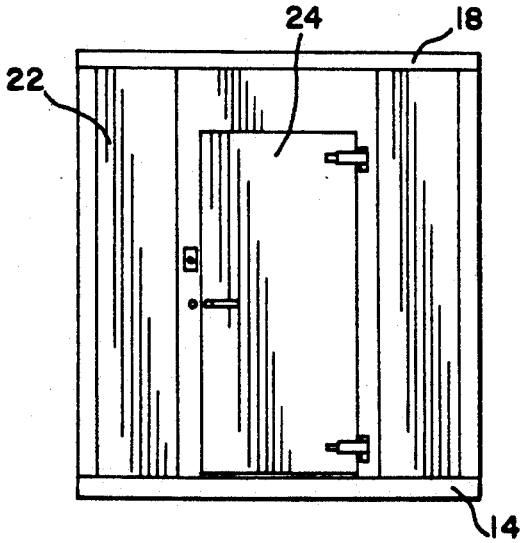
FIG. 3 is an end view of one end of the refrigeration unit of FIG. 1.

A base frame 26, for horizontally supporting the floor 14 of the structure 12 above the ground 30, is illustrated in greater detail in FIG. 2. The structure 12 is generally rectangular, and the frame 26 comprises a plurality of longitudinally oriented beams 32 and a plurality of transverse cross-members 34. The beams 32 comprise 4"×4"timbers, and the cross-members 34 comprise 2"×4"wood timber, notched into the beams.

Figure 6:
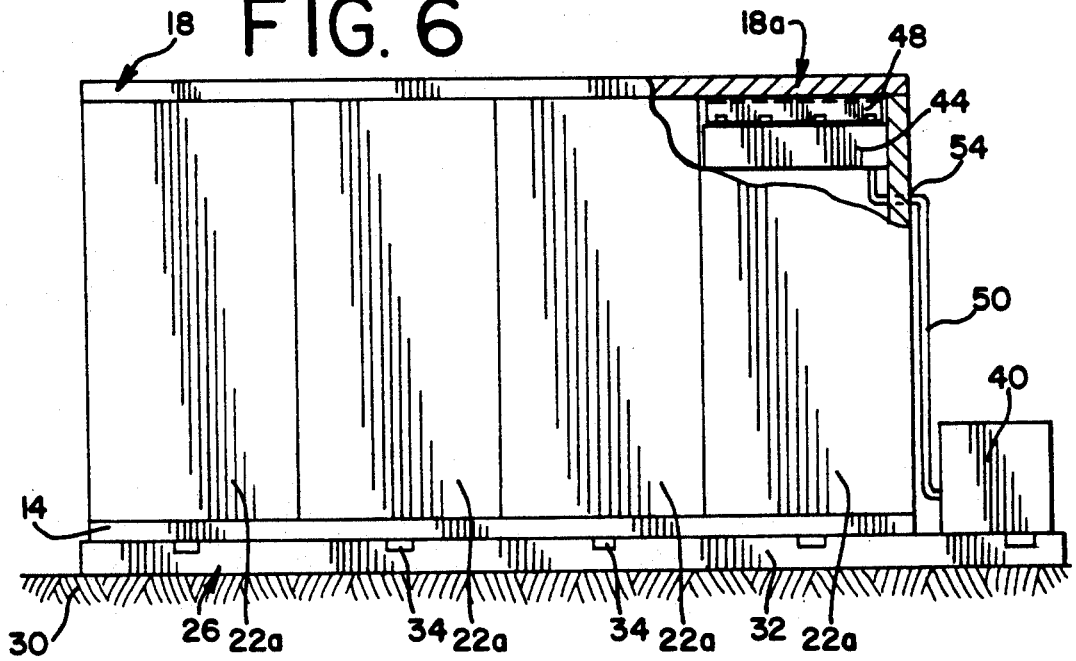
FIG. 6 is a side view of the refrigeration unit of FIG. 1.

As illustrated in FIG. 6, the frame 26 extends outwardly beyond the structure 12, providing an external surface to support a refrigeration compressor 40. The compressor 40 is a unit sold by Thermo-King of Minnesota.

Figure 4:
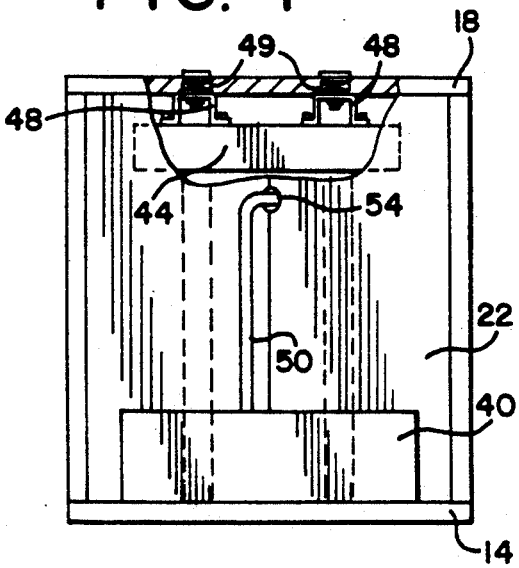
FIG. 4 is an end view of the other one end of the refrigeration unit of FIG. 1.
Figure 5:
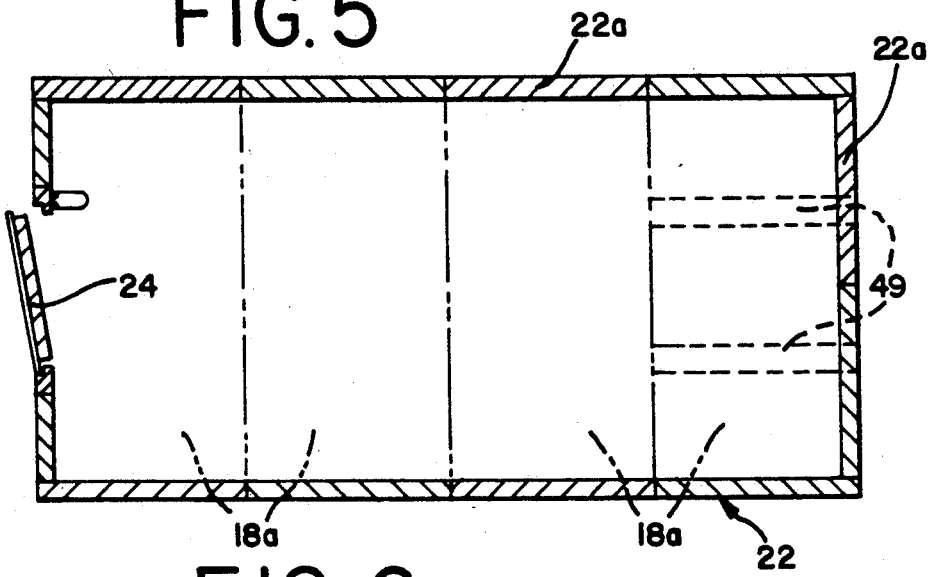
FIG. 5 is a top view of the refrigeration unit of FIG. 1.

As illustrated in FIGS. 4 and 6, a refrigeration evaporator unit 44 is secured to the roof 18 by a pair of parallel, generally U-shaped channels 48. The channels 48 are secured to the roof 18 by two 2"×4"timbers 49 embedded therein (FIG. 5). The evaporator unit 44 is a remote evaporator, also sold by Thermo-King. The refrigeration compressor 40 and the refrigeration evaporator 44 are operatively coupled together by a pipe or conduit means 50. Two adjacent ones of the panels include a notch or indentation in one panel edge or two adjacent panel edges hereinafter referred to as "notch means" to form an aperture 54 when the panels are positioned side-by-side as shown, for example, in FIG. 4. The apertures 54 permit passage of the pipe 50 through the wall. The unit 10 can be repetitively assembled and disassembled, without disconnecting the evaporator unit 44 from the condenser unit 40. This arrangement simplifies assembly and prevents release of refrigerant from the pipe 50.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A portable, modular, readily assembled and disassembled refrigerated storage structure adapted to be transported disassembled to otherwise inaccessible locations and then assembled on-site comprising:

an insulated structure including a floor, a roof, a plurality of wall panels, and means for removably interconnecting said wall panels to form a continuous wall disposed between said floor and said roof; a refrigeration means including an evaporator unit and a separate compressor unit operatively connected together by a conduit means;

means adapted for supporting said refrigeration evaporator unit within said structure in a location above said floor;

a base frame supporting said floor and said structure generally horizontally, said base frame extending in one direction beyond said floor to provide an extension area, said extension area being adapted to support said refrigeration compressor unit;

at least one of said wall panels including a notch means in an edge thereof, said notch means being adapted to accommodate passage of said conduit means operatively coupling said evaporator unit to said compressor unit to thereby permit ready assembly and disassembly of said structure without the necessity of disconnecting said conduit from said compressor or evaporator unit.

2. The portable, modular readily assembled and disassembled refrigerated storage structure of claim 1 wherein two adjacent ones of said panels include notch means in opposed edges thereof aligned to form an aperture, said aperture adapted to permit passage of a conduit means coupling said evaporator unit and said compressor unit so that said panels may be erected around said conduit means without the necessity of disconnecting said conduit means said evaporator or compressor units.

3. The portable, modular refrigerated structure of claim 1 wherein said structure is generally rectangular in both plan and elevation and said base frame comprises a plurality of large interconnected longitudinally oriented beams in the longer dimension of said rectangle and a plurality of smaller transverse cross-members in the shorter dimension of said rectangle.

4. The portable, modular refrigerated storage structure of claim 1 wherein said means adapted for supporting a refrigeration evaporator unit within said structure comprises a pair of generally U-shaped channels each secured to said roof whereby said refrigeration evaporator unit is disposed in spaced relationship above said floor.

5. The portable, modular refrigerated storage structure of claim 3 wherein said base unit comprises at least three of said longitudinally oriented beams and at least four of said transverse cross members with at least one of said transverse cross members being in the extension area adapted to support said refrigeration compressor unit.

* * * * *